United States Patent [19]

Habermann et al.

[11] 3,977,959

[45] Aug. 31, 1976

[54] ANODES FOR ELECTROLYSIS

[75] Inventors: Wolfgang Habermann, Mainz; Wolfgang Bruck, Hemsbach; Werner Simmler, Ludwigshafen, all of Germany

[73] Assignee: BASF Aktiengesellschaft, Ludwigshafen (Rhine), Germany

[22] Filed: Sept. 9, 1974

[21] Appl. No.: 504,673

[30] Foreign Application Priority Data

Sept. 13, 1973 Germany ..... 2346055

[52] U.S. Cl. ..... 204/290 F; 204/290 R; 204/293

[51] Int. Cl.[2] ..... C25B 10/10; C25D 17/10

[58] Field of Search ..... 204/290 R, 290 F, 293

[56] References Cited

UNITED STATES PATENTS

| | | | |
|---|---|---|---|
| 3,291,214 | 12/1966 | Hall et al. | 204/256 |
| 3,632,498 | 1/1972 | Beer | 204/290 F |
| 3,649,485 | 3/1972 | Chisholm | 204/95 |

*Primary Examiner*—F.C. Edmundson
*Attorney, Agent, or Firm*—Johnston, Keil, Thompson & Shurtleff

[57] ABSTRACT

An electrode for electrolysis which contains tantalum, tantalum boride, tantalum carbide or an alloy of tantalum with a metal of the iron group in addition to an alloy of tungsten with a metal of the iron group.

9 Claims, No Drawings

ANODES FOR ELECTROLYSIS

Anodes of graphite, magnetite, lead dioxide and of precious metals and preferably of platinum metals are mainly used for electrolysis. Since these electrodes either exhibit high overvoltages or have inadequate resistance to corrosion and in some cases are too expensive, anodes based on titanium with a thin coating of a platinum metal have been developed recently. The applications of such anodes are of course limited in the case of high anodic current densities because particularly in electrolytes containing halides there is a continuous increase in the overvoltage. Moreover in a number of electrolytic processes the platinum metal is slowly detached so that the electrodes often have to be replaced after short periods.

Furthermore anodes are disclosed in German Laid-Open Specification (DOS) No. 1,671,422 which, on a conducting core, have a coating of a combination of at least one oxide of one or more electrolytic film-forming metals with an electrolytic non-film-forming conductor. Preferred combinations are mixed oxides, for example mixed oxides of titanium oxide and ruthenium oxide. Such anodes prove in continuous operation at high loads to be far more useful than titanium anodes coated with platinum metals. It has been found, however, that in the course of time a slow increase in the overvoltage takes place so that the life of the electrodes is limited.

Decisive factors in the inactivation of such titanium anodes are that particularly at high current densities not only is precious metal dissolved out but also a non-conducting layer of oxide forms between the titanium carrier material and the coating and this slowly increases due to continuous oxidation of the titanium carrier.

We have now found that the said disadvantages do not occur in the case of electrodes for electrolysis which contain tantalum, tantalum boride, tantalum carbide or an alloy of tantalum with a metal of the iron group, singly or mixed together, in addition to an alloy of tungsten with one or more metals of the iron group.

The proportion of tantalum, tantalum boride, tantalum carbide or an alloy of tantalum should be at least 10% by weight and preferably from 30 to 60% by weight in each case calculated as tantalum in order to obtain a well adherent, dense, corrosion-proof layer which will ensure adequate protection of the electrically conducting carrier. In the case of tantalum contents of more than about 70% by weight extremely stable and resistant anodes are obtained but such electrodes exhibit somewhat higher overvoltages so that as a rule higher contents of tantalum are to be avoided.

Metals of the iron group are particularly advantageous as alloying components for the metals tungsten and tantalum because low overvoltages may be achieved with these elements. Iron is particularly suitable; as hereinafter described, iron when doped with rhodium salt solutions containing chloride gives readily volatile iron compounds and ensures good adhesion of the platinum metals. The content of metals of the iron group in the electrode should be from 0.5 to less than 10% and preferably from 1.5 to 5% by weight. Higher iron contents impair resistance to corrosion whereas too low an iron content does not ensure adequate bonding of the platinum metal. In cases when the electrode contains tantalum in the form of an alloy with a metal or metals of the iron group the proportion of iron in the tungsten alloy to that in the tantalum alloy should be from 1:0.1 to 1:5.

Platinum metals are suitable for doping the electrodes. Rhodium has proved to be the most favorable metal because at high anodic current densities it is superior to all other platinum metals as regards bond strength to the electrode surface. The content of platinum metal should be less than 1.5 g/m$^2$ and preferably from 0.2 to 0.6 g/m$^2$ of electrode surface. The electrodes may be used as such or applied to an electrically conducting carrier.

Suitable electrically conducting carriers are materials which are substantially stable in the electrolytes used. Titanium, graphite and particularly alloys of titanium with tantalum and of titanium with tungsten are preferred, because these alloys are particularly resistant to corrosion. The content of tantalum and tungsten in the alloys should be at least 10% by weight in order to achieve an appreciable improvement as compared with unalloyed titanium.

The electrodes may be prepared by applying a mixture consisting of a particulate alloy of tungsten with a metal of the iron group and particulate tantalum, tantalum carbide, tantalum boride or an alloy of tantalum with a metal of the iron group by means of a plasma burner to an electrically conducting carrier and then doping the layer thus applied superficially with a platinum metal and particularly rhodium. The particle size of the metal powder used should be from about 40 to 100 microns. Application should be made under an atmosphere of a protective gas, preferably argon, to avoid oxidation of the applied layer. The electrodes may also be prepared by rolling layers of the above-mentioned mixtures onto an electrically conducting carrier or by plating the latter therewith.

The layers applied to the electrically conducting carrier should be thicker than 0.1 mm. Preferred layer thicknesses are from 0.1 to 0.8 mm.

In the production of electrodes without a carrier the procedure may be for example that a mixture of particulate components is applied by means of a plasma burner to a carrier of a base metal which is then removed again for example by treatment with an acid or caustic alkaline solution after which the layer obtained is doped with a platinum metal.

To dope the electrodes they are impregnated with a from 0.1 to 10% and particularly from 0.5 to 3% by weight solution of an inorganic platinum metal compound and then annealed at from +600°C to +1200°C and preferably from +800°C to +900°C under an atmosphere of protective gas for from about one second to ten seconds. An aqueous solution of rhodium(III) chloride with a pH of from 0 to 0.5 has proved to be particularly advantageous for doping. When use is made of this solution and the ferriferous tungsten and tantalum alloys there are obtained a particularly stable doping and clean electrode surfaces because the iron chlorides formed in the doping immediately sublime off. Moreover such electrode surfaces uncontaminated by oxides exhibit particularly low overvoltages. Doping itself has to be carried out in an atmosphere of protective gas or in high vacuum in order to avoid oxidation. Argon is preferably used as the protective gas.

Electrodes according to the invention may be used particularly as anodes in the electrolysis of waste water effluents to purify them, the electrolytic production of chlorine, chlorates, hypochlorites, persulfates, perborates, oxygen and the like, electrocoagulation, as anodes in organic electrolytic processes and in electroplating baths.

The following Examples illustrate the invention.

EXAMPLE 1

A sheet of titanium having the dimensions: 30 mm × 20 mm × 2 mm is sandblasted and coated on one side with a particulate mixture consisting of 50 parts by weight of an alloy of 95% by weight of tungsten and 5% by weight of iron and 50 parts by weight of tantalum to a thickness of about 0.25 mm. The coated side is then impregnated with a 1.5% by weight solution of rhodium(III) chloride (calculated as $RhCl_3$) at pH 0.2. After drying the layer is heated for about two seconds with an argon-nitrogen plasma to about +900°C and cooled again to ambient temperature with nitrogen.

The finished anode is eminently suitable for the electrolysis of dye waste aqueous liquids, alkali metal chloride solutions and sulfuric acid. The current-voltage values given below result in the various electrolytes with the said electrode.

| Electrolyte | Anode potential $\epsilon_r$ | Current density | Temperature °C |
|---|---|---|---|
| sulfuric acid 10% | 1380 mV | 5 A/cm² | 25 |
| sulfuric acid 10% | 1500 " | 15 | 25 |
| sodium chloride | 1140 " | 50 | 80 |
| solution 26% | 1210 " | 500 | 80 |
| fluoresceine waste water | 1580 " | 5 | 20 |
| (0.5% fluoresceine) | 1690 " | 15 | 20 |
| CI Disperse Red 92 waste | 1360 " | 5 | 20 |
| water (0.5% dye) | 1540 " | 15 | 20 |

$\epsilon_r$ =with reference to calomel

After batchwise operation in the electrolytes given above for more than twelve months an increase in overvoltage of only 20 mV could be determined by a comparative measurement in 10% by weight aqueous sulfuric acid.

No increase in overvoltage was found in aqueous concentrated hydrochloric acid at a current density of 15,000 A/dm² after one hundred days of operation. In contrast the increase in overvoltage with an anode having a titanium-ruthenium oxide coating tested comparatively is more than 60 mV.

EXAMPLE 2

A sheet of titanium as described in Example 1 is covered to a thickness of about 0.3 mm with a mixture consisting of 50% by weight of an alloy of tantalum and iron (96% by weight of Ta and 4% by weight of iron) and 50% of an alloy of tungsten and iron (99% by weight of W and 1% by weight of Fe). The alloy is then impregnated with a 1.5% by weight aqueous solution of rhodium(III) chloride in hydrochloric acid. After drying the alloy is annealed in an oxygen-free argon plasma for about three to five seconds at +600°C and cooled under argon. The finished anode may be used particularly for electrolysis p of waste aqueous effluent and mineral acids.

The following current-voltage values are obtained in aqueous 10% by weight sulfuric acid.

| Anode potential $\epsilon_r$ in mV | Current density A/dm² | Temperature +°C |
|---|---|---|
| 1,325 | 5 | 22 |
| 1,368 | 10 | 22 |

-continued

| Anode potential $\epsilon_r$ in mV | Current density A/dm² | Temperature +°C |
|---|---|---|
| 1,385 | 15 | 22 |

No increase in the overvoltage is determined after a period of six months.

EXAMPLE 3

In the manner described in Example 1 a particulate mixture consisting of 50% by weight of an alloy of 97 parts by weight of tungsten and 3 parts by weight of iron and 50% by weight of tantalum carbide is applied to a sheet of titanium and then activated with a solution of rhodium(III) chloride.

The finished electrode is installed as anode in an electroseparator which is being used for separating an suspension of aluminum organyl in ethylbenzene. Coagulation of the aluminum organyl is possible with direct voltage at a field strength of 40 V/cm.

EXAMPLE 4

As described in Example 1 a mixture consisting of 50% by weight of a particulate alloy of 96 parts by weight of tungsten and 4 parts by weight of cobalt and 50% by weight of particulate tantalum boride is applied to a sheet of titanium and activated with a solution of rhodium(III) chloride. The finished electrode is used as anode in an electroseparator for the separation of iron carbonate from water. At a field strength of 6 V/cm it is possible to decrease the iron content by flocculation from about 5 mg/l to less than 0.02 mg/l.

EXAMPLE 5

A particulate mixture consisting of 50% by weight of an alloy (with 95% by weight of tungsten and 5% by weight of iron) and 25% by weight of tantalum boride and also 25% of tantalum is applied to a tantalum-coated sheet of titanium having the dimensions 30 mm × 20 mm × 2 mm by means of a plasma burner on one side to a thickness of about 0.3 mm. The side coated with the alloy is then impregnated with a 1.5% by weight solution of rhodium(III) chloride. After drying this layer is heated for about three seconds to about +900°C with an argon plasma and cooled with argon.

The finished anode is particularly suitable for the electrolysis of corrosive and seriously soiled waste aqueous water, for example waste water containing methyl violet or C.I. Disperse Red 92.

The following current-voltage values are obtained in aqueous 10% by weight sulfuric acid:

| Anode potential $\epsilon_r$ mV | Current density A/dm² | Temperature °C |
|---|---|---|
| 1360 | 5 | 19 |
| 1440 | 15 | 19 |

We claim:

1. An anode for electrolysis which comprises an electrically conducting member coated with an electrode material consisting essentially of a. an alloy of tungsten with at least one metal of the iron group and b. at least one member of the group consisting of tantalum, tantalum boride, tantalum carbide and an alloy of tantalum with at least one metal of the iron group, with the proviso that the content of a metal of the iron group in said anode is about 0.5 to less than 10% by weight with reference to the total weight of (a) and (b) and that said electrode material is doped by impregnation with a platinum metal.

2. An anode as claimed in claim 1 wherein the proportion of metals of the iron group contained in the electrode material is from 1.5 to 5% by weight.

3. An anode as claimed in claim 1 in which said electrode material contains a proportion of (a) tantalum, tantalum carbide, tantalum boride and/or the tantalum alloy, in each case calculated as tantalum, in an amount of at least 10% by weight up to about 70% by weight.

4. An anode as claimed in claim 3 in which said electrode material contains a proportion of component (a), in each case calculated as tantalum, in an amount of about 30 to 60% by weight.

5. An anode as claimed in claim 1 wherein components (a) and (b) are applied to an electrically conducting member consisting essentially of titanium, graphite, an alloy of titanium and tantalum, or of an alloy of titanium and tungsten.

6. An anode as claimed in claim 5 in which the content of tantalum and tungsten in their respective alloys with titanium is at least 10% by weight.

7. An anode as claimed in claim 1 wherein the content of platinum metal is less than 1.5 $g/m^2$ of anode surface formed by said electrode material.

8. An anode as claimed in claim 1 wherein the content of platinum metal is from about 0.2 to 0.6 $g/m^2$ of anode surface formed by said electrode material.

9. An anode as claimed in claim 1 wherein said electrode material has been doped by impregnation with rhodium as the platinum metal in the form of an aqueous solution of rhodium(III) chloride.

* * * * *